US005389732A

United States Patent [19]

Sekino

[11] Patent Number: 5,389,732

[45] Date of Patent: Feb. 14, 1995

[54] DEVELOPING DEVICE WITH A SEALING CONSTRUCTION FOR PREVENTING TONER LEAKAGE

[75] Inventor: Hitoshi Sekino, Toyokawa, Japan

[73] Assignee: Minolta Camera Kabushiki Kaisha, Osaka, Japan

[21] Appl. No.: 145,226

[22] Filed: Nov. 3, 1993

[30] Foreign Application Priority Data

Nov. 6, 1992 [JP] Japan ..... 4-76561
Dec. 28, 1992 [JP] Japan ..... 4-89373

[51] Int. Cl.[6] ..... G03G 15/08

[52] U.S. Cl. ..... 118/653; 355/215; 355/245; 355/259

[58] Field of Search ..... 355/251, 253, 259, 215, 355/245; 118/656–658, 653

[56] References Cited

U.S. PATENT DOCUMENTS 4,897,693 1/1990 Sawayama ..... 355/215
5,057,868 10/1991 Sekino et al. ..... 355/215
5,134,960 8/1992 Shirai ..... 118/653
5,166,733 11/1992 Eliason ..... 355/251
5,177,536 1/1993 Watanabe et al. ..... 355/251
5,187,326 2/1993 Shirai ..... 118/657
5,212,521 5/1993 Ogawa et al. ..... 355/215
5,274,425 12/1993 Fukumoto et al. ..... 355/215
5,287,150 2/1994 Kinoshita et al. ..... 355/259

*Primary Examiner*—R. L. Moses
*Attorney, Agent, or Firm*—Burns, Doane, Swecker & Mathis

[57] ABSTRACT

A developing device having a sealing construction for preventing a toner leakage therefrom. The developing device having a housing for accommodating a toner therein, a developing sleeve supported at the housing for holding a toner on a peripheral surface thereof, a scraper one end of which is supported at the housing and the other end of which is pressed in contact with the peripheral surface of the developing sleeve along an axial direction of the developing sleeve for regulating means for regulating an amount of the toner supplied to said peripheral surface of said developing sleeve. The space among the housing, the developing sleeve and the scraper is sealed by a square-frame shaped seal member.

11 Claims, 6 Drawing Sheets

DEVELOPING DEVICE WITH A SEALING CONSTRUCTION FOR PREVENTING TONER LEAKAGE

BACKGROUND OF THE INVENTION

1. Field of the Invention

The present invention relates to a developing device for use in image forming apparatus such as copying machines, printers and the like, and more specifically relates to a seal member and a supporting portion of a regulating member in a developing device.

2. Description of the Related Art

FIGS. 1 through 4 show the construction of conventional developing devices. In this developing device 50, the housing 51 is provided with a roller accommodating compartment 52 disposed opposite a photosensitive member (not illustrated), and a toner supply compartment 53 disposed posteriorlyto said compartment 52. The roller accommodating compartment 52 and the toner supply compartment 53 are interconnected via a transverse inlet 54.

The developing roller 55 is arranged in the roller accommodating compartment 52, such that both ends of the support shaft (not illustrated) are inserted in receptacles 56 provided on the side panels of the housing 51 so as to be freely rotatable while supported.

The regulating panel 57 is arranged behind the developing roller 55, the top portion of said regulating panel 57 is fixedly mounted to the front wall 58 of the toner supply compartment 53, the bottom free end of said panel 57 is in pressure contact with the exterior surface of the developing roller 55.

The elastic seal member 62 comprises four members 63, 66, 66, and 67, i.e., bottom seal member 63 provided with a side seal member 65 at bilateral ends of the bottom seal 64, side seal members 66 and 66, and top seal member 67. The elastic seal member 62 forms a seal between the roller accommodating compartment 52 and toner supply compartment 53, when the bottom seal 64 is interposed medially to the bottom of the housing 51 and the bottom exterior surface of the developing roller 55, the side seals 65 and 65 and the side seal members 66 and 66 are interposed medially to the side walls of the housing 51 and both end surfaces of the developing roller 55, and the top seal member 67 is interposed medially to the regulating member 57 and the housing 51.

The seal member 68 comprises a body 69 arranged in the axial direction of the developing roller 55, and side seals 70 and 70 extending from bilateral ends of said body 69 along the exterior surface of the developing roller 55. The end portions of the body 69 are fixedly attached to the bottom of the housing 51, the body 69 is interposed medially to the bottom seal 64 and the developing roller 55, and the side seals 70 and 70 are interposed medially to the side seals 65 and 65, side seal members 66 and 66 and the developing roller 55. The ends of the side seals 70 and 70 are stretched under tension in the arrow direction via a force imparting means not shown in the drawings.

Since the aforesaid elastic seal member 62 comprises the aforesaid tightened four members 63, 66, 66 and 67, when the developing device 50 is arranged horizontally, the toner may leak from the seams of the seal members 63, 66, 66 and 67 into the roller accommodating compartment 52, which has the disadvantage of dispersing toner within the apparatus.

The regulating panel 57 makes direct contact with the housing 51, and is covered by metal panels 59 and 60 which act as reinforcing members that are fixedly attached thereto by a plurality of screws 61. As shown in FIG. 3, the regulating panel 57 partially mounted by screws 61 is thereby fixedly attached to the housing 51. Although a suitable quantity of toner is maintained on the developing roller 55 in the aforesaid portion, in the areas between the screws 61 the metal panels 59 and 60 are lifted via the return force of the regulating panel 57 as shown in FIG. 4, such that the regulating panel 57 exerts a weak pressure on the developing sleeve 55, and toner in excess of the standard quantity is maintained on the developing roller 55 passing this portion, thereby causing spotting of the image density.

SUMMARY OF THE INVENTION

A main object of the present invention is to provide a developing device capable of suitably developing an electrostatic latent image formed on the surface of a photosensitive member.

A further object of the present invention is to provide a developing device which does not disperse toner in the vicinity of the developing device.

A still further object of the invention is to provide a developing device capable of maintaining a predetermined quantity of toner on the developing roller.

These objects of the present invention are achieved by providing a developing device having a sealing construction for preventing a toner leakage therefrom, said developing device comprising:

accommodating means for accommodating a toner therein;

a rotatable member supported at said accommodating means for holding a toner on a peripheral surface thereof;

regulating means for regulating an amount of the toner supplied to said peripheral surface of said rotatable member, said regulating means including a scraper one end of which is supported at the accommodating means and the other end of which is pressed in contact with the peripheral surface of the rotatable member along an axial direction of the rotatable member; and a square-frame shaped seal member arranged between the rotatable member and the accommodating means, said seal member having a bottom seal portion which seals a space interposed between the rotating member and a bottom of the accommodating means, a side seal portion which seals a space interposed between both ends of the rotatable member and a side wall of the accommodating means opposed thereto,and a top seal portion which seals a space interposed between the scraper and a top wall of the accommodating means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
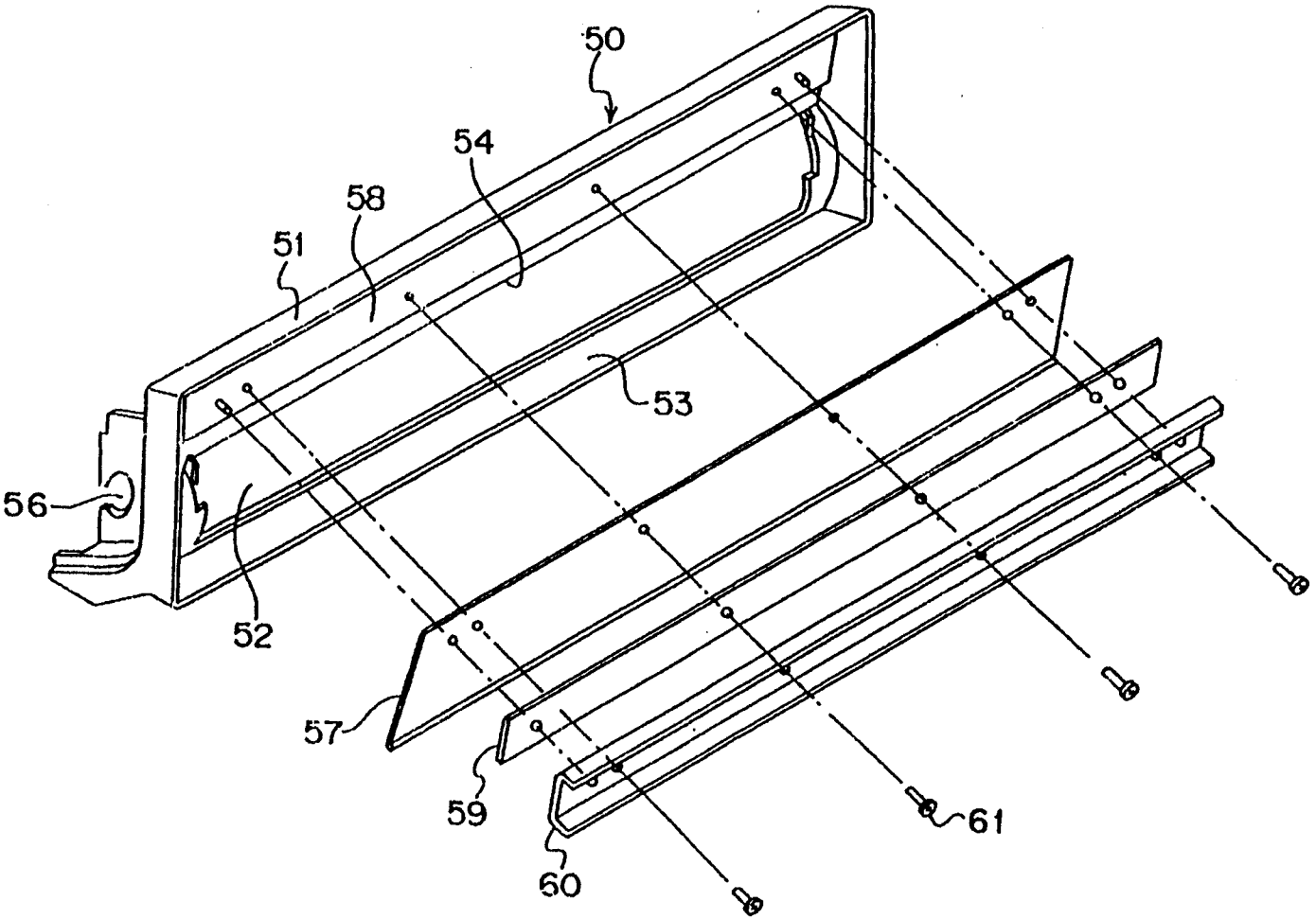
FIG. 1 Prior Art
FIG. 1 is a perspective view showing part of a conventional developing device.
Figure 2:
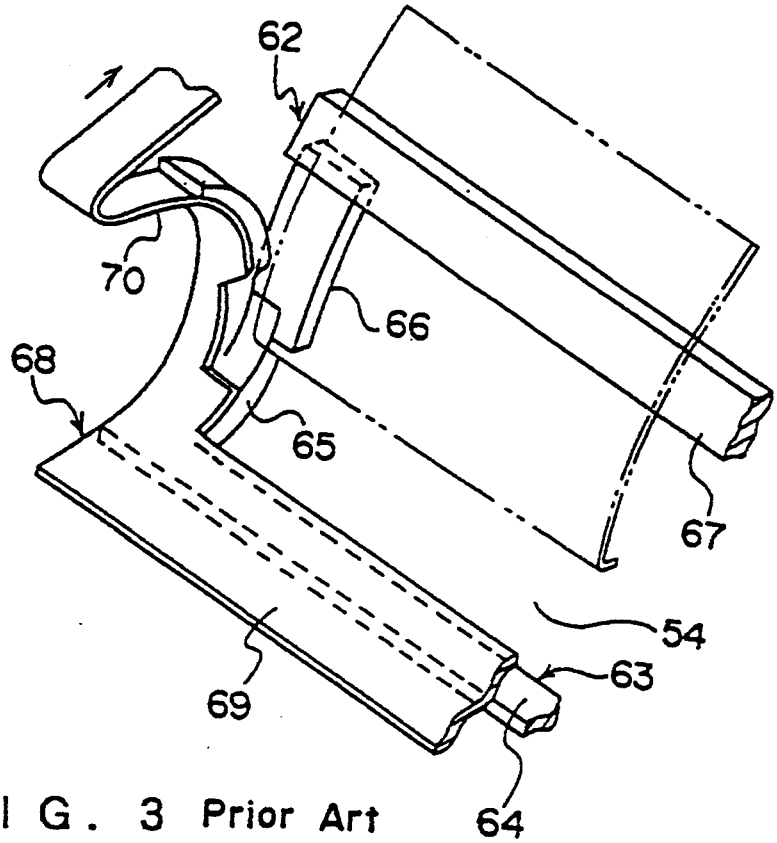
FIG. 2 Prior Art
FIG. 2 is an illustration showing the relationships among the elastic seal member, regulating panel, and seal panel in a conventional developing device.
Figure 3:
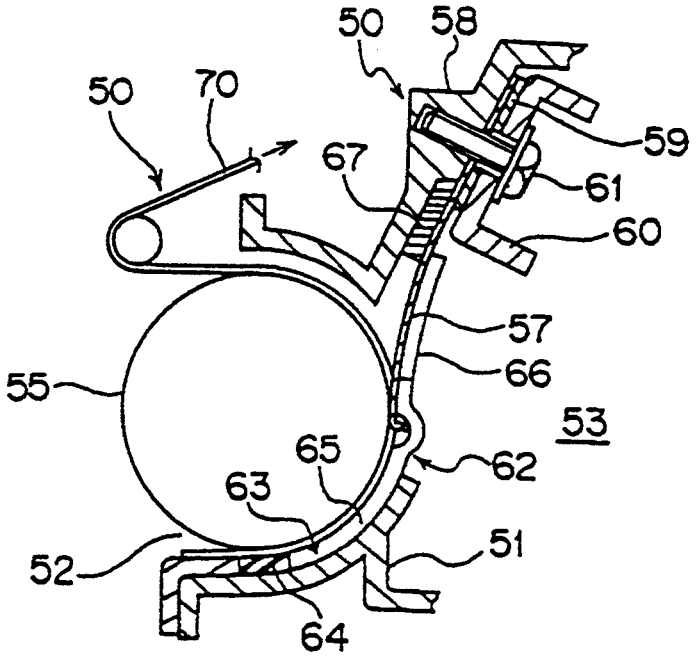
FIG. 3 Prior Art
FIG. 3 is a partial section view of a conventional developing device.
Figure 4:
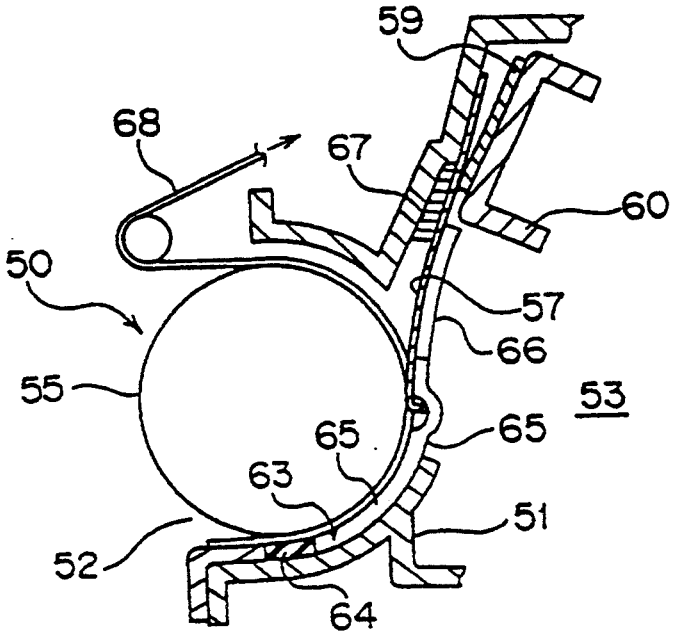
F I G. 4 Prior Art
FIG. 4 is a partial section view of a conventional developing device showing a modified regulating panel.
Figure 5:
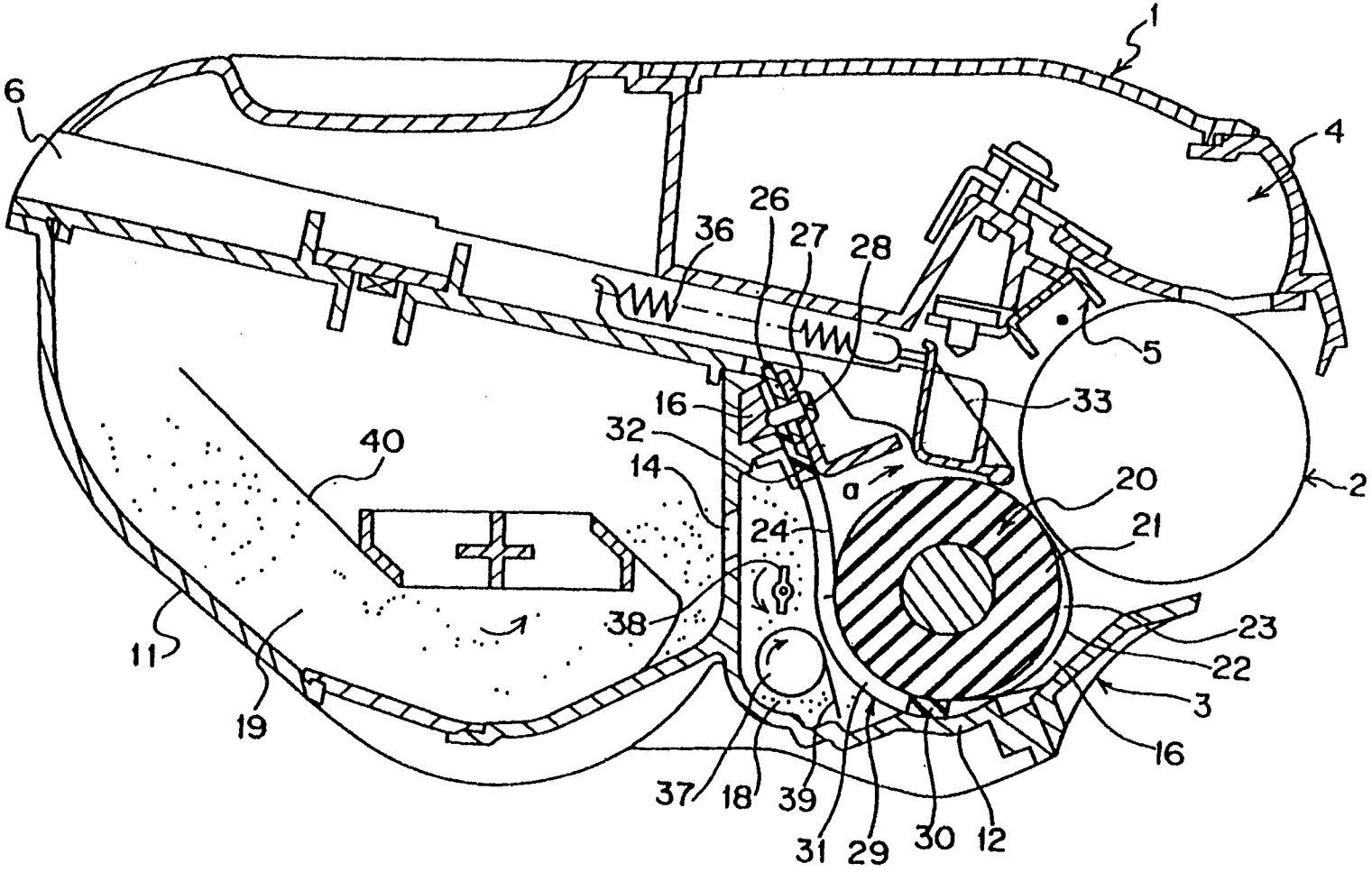
FIG. 5 is a section view of the developing device of the present invention.

FIG. 5 shows an imaging cartridge 1 removably installed in an image forming apparatus such as a copying machine, printer or the like. The imaging cartridge 1 comprises an integrated arrangement of a photosensitive member 2, developing device 3, cleaning unit 4, and charger 5. An exposure path 6 extends opposite the photosensitive member 2 and medially to the developing device 3 and the cleaning unit 4.

In the aforesaid developing device 3, a toner supply compartment 18 is formed at the front of the housing 11 and behind the roller accommodating portion 17. A toner hopper 19 is formed at the back of the housing 11.

The developing roller 20 comprises a roller 21 having a rubber layer overlaying a cylindrical metal core, and a thin layer sleeve 22 sheathed over said roller 21. The developing roller 20 is arranged in the previously mentioned roller accommodating compartment 17, and is mounted so as to be rotatable via support shafts 15.

The aforesaid thin layer sleeve 22 comprises a thin cylindrical body of electroplated nickel having a circumferential length somewhat longer than the roller 21. The outer surface of the sleeve 22 is toughened by a sandblasting process, and the sleeve is installed so as to house the roller 21 therein, and in which state some slack is allowable.

The regulating panel 24 is a rectangular panel, one edge of which is supported by two metal plates 26 and 27, and which is fixedly attached to the top rear wall of the roller accommodating compartment 17 via a plurality of screws 28. The free edge 25 of the regulating panel 24 makes pressure contact with the surface of the roller 21 via thin layer sleeve 22, and in the area of said contact the free edge 25 bends radially to the roller 21.

The elastic seal member 29 is a square-frame shaped panel-like member formed of polyurethane foam, and is arranged behind the roller 21. The elastic seal member 29 is fixedly attached via adhesive when the bottom seal portion 30 is interposed medially to the developing roller 20 and the housing bottom 12, the side seal portion 31 is interposed medially to the developing roller 21 and the housing side wall 13 opposite the exterior surface at both ends of the developing roller 20, and the top seal portion 32 is interposed medially to the regulating member 24 and the housing top rear wall 16.

Figure 7:
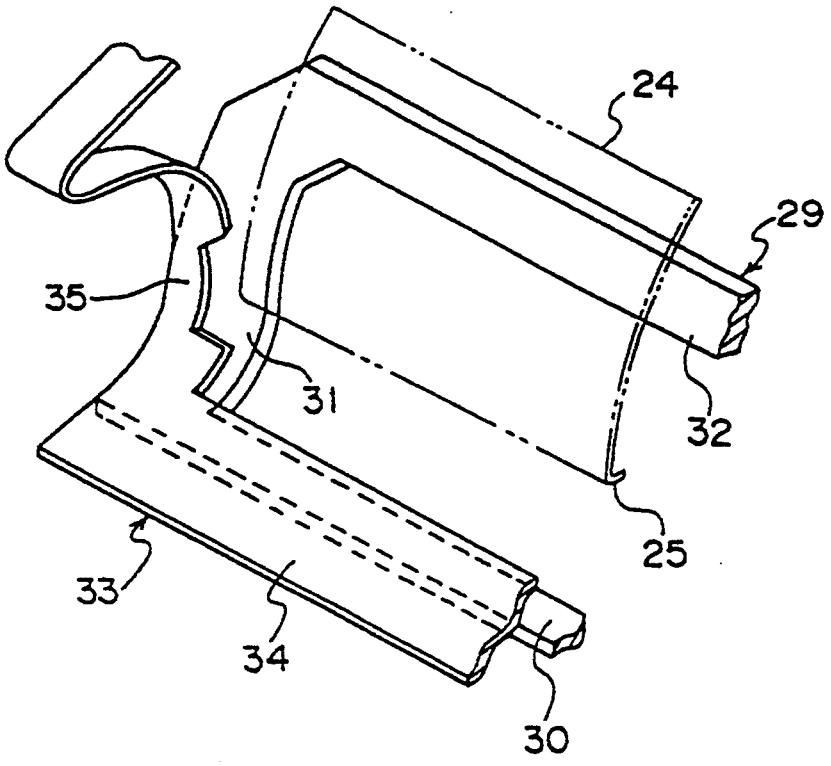
FIG. 7 is an illustration showing the relationship among the elastic seal member, regulating panel, and seal panel of the developing device of FIG. 5.

As shown in FIG. 7, the seal panel 33 is formed of polyester foam or the like, which assumes a U-shape configuration via the side portions 35 and 35 which extend perpendicularly from the bilateral ends of the body 34. The edge portion in the lengthwise direction of the body 34 is fixedly attached to the housing bottom 12, and said body 34 is gripped between the roller 21 and the housing bottom 12. The side portions 35 and 35 are arranged along the exterior surface edge of the developing roller 20, and are connected to one end of the spring 36 provided in the exposure path 6. Thus, as shown in FIG. 5, the back portion of the thin layer sleeve 22 is sealed against the roller 21, and the slack of the thin layer sleeve 22 collects opposite the photosensitive member so as to form a vacant space 23, and the thin layer sleeve 22 having said formed vacant space 23 comes into contact with the photosensitive member 2.

The friction coefficient between the exterior surface of the roller 21 and the interior surface of the thin layer sleeve 22 is designated $\mu 1$, and the friction coefficient between the exterior surface of the thin layer sleeve 22 and the seal panel 33 is designated $\mu 2$, the relationship $\mu 1 > \mu 2$ obtains. When the roller 21 rotates in the arrow a direction, the roller 21 and the thin layer sleeve 22 are rotatable at the same uniform speeds.

The toner supply compartment 18 is provided with a mixing roller 37, and a mixing blade 38 positioned thereabove, with a scraper 39 making pressure contact with the exterior surface of said mixing roller 37. The toner supply compartment 18 is connected to the toner hopper 19 via the inlet 14. The mixing blade 40 is accommodated in the toner hopper 19.

In the developing device 1 of the previously described construction, toner is stored within the toner hopper 19, and supplied to the toner supply compartment 18 via the inlet 14 while said toner is mixed via the rotation of the mixing blade 40. Although a non-magnetic toner is typically used as the aforesaid toner, a magnetic toner may also be used.

The toner in the toner supply compartment 18 is mixed via the rotation of the mixing blade 38 to prevent retention of the toner, and the excess toner in the toner supply compartment 18 is returned to the toner hopper 19 through the inlet 14, such that a suitable amount of toner is maintained in the toner supply compartment 18. The toner is transported in the arrow direction by the mixing roller 37, scraped by the scraper 39 so as to be pressed on the exterior surface of the thin layer sleeve 22, such that said toner is moved in the arrow a direction in accordance with the rotation of the thin layer sleeve 22 which rotates in conjunction with the roller 21. The force with which the toner is pressed onto the thin layer sleeve 22 is weakened by the movement of the toner in conjunction with the rotation of the mixing blade 38, so as to maintain a suitable pressure force of the toner relative to the thin layer sleeve 22.

The toner transported to the leading edge of the regulating panel 24 in conjunction with the rotation of the thin layer sleeve 22 is disposed at the wedge-like portion formed by the leading edge of the regulating panel 24 and the thin layer sleeve 22 so as to be pressed on said thin layer sleeve 22, and a uniform amount of toner coats the exterior surface of the thin layer sleeve 22 as the toner passes the leading edge of the regulating panel 24. At this time, a charge of predetermined polarity is imparted to the toner.

The toner which passes the leading edge of the regulating panel 24 is transported to the contact portion between the photosensitive member 2 and the thin layer sleeve 22 which rotates in conjunction with the roller 21. The aforesaid toner adheres to the electrostatic latent image formed on the surface of the photosensitive member 2 by means of the electricalfield produced by the difference in electrical potentials of the bias potential imparted to the thin layer sleeve 22 and the surface potential of the photosensitive member 2, thereby forming a toner image.

The thin layer sleeve 22, when in contact with the photosensitive member 2, forms a vacant space 23 between the roller 21 and said sleeve 22. Accordingly, the toner comes into soft and uniform contact with the photosensitive member 2 via the rigidity of the thin layer sleeve 22 and a suitable nip width, thereby uniformly developing the electrostatic latent image formed on the surface of the photosensitive member 2 so as to produce a visible developed image.

The residual toner that is not supplied to the electrostatic latent image and which remains on the surface of the thin layer sleeve 22 is transported in the direction of arrow a with the thin layer sleeve 22, passes the contact portion of the bottom seal 30, and is delivered to the toner supply compartment 18. Fresh toner is added to compensate for the consumed toner, said toner filling the toner supply compartment from the toner hopper 19 in an amount equivalent to the amount of consumed toner.

The portion between the thin layer sleeve 22 and the housing 11 is sealed by the elastic seal member 29 and seal panel 33. A stable force is exerted upon the seal member 33 by the spring 36, thereby preventing leakage of the toner from the toner supply compartment 18. Further, the seal is complete since the elastic seal member 29 is formed as a seamless integrated piece.

The regulating panel 24 is gripped by the metal panel 27 which acts as a reinforcing member, and the metal panel 26 which acts as a point of support for the spring force of the regulating panel 24. The metal panels 26 and 27 are integrated via a plurality of screws 28', and are fixedly attached to the housing 11 at two points at bilateral ends via screws 28.

Accordingly, deformation in the support portion of the regulating panel 24 is suppressed even though the regulating panel 24 is in pressure contact with the thin layer sleeve 22. Thus, the leading edge of the regulating panel 24 is in uniform pressure contact with the thin layer sleeve 22, and the amount of travel of the toner on the thin layer sleeve 22 is constant.

Figure 6:
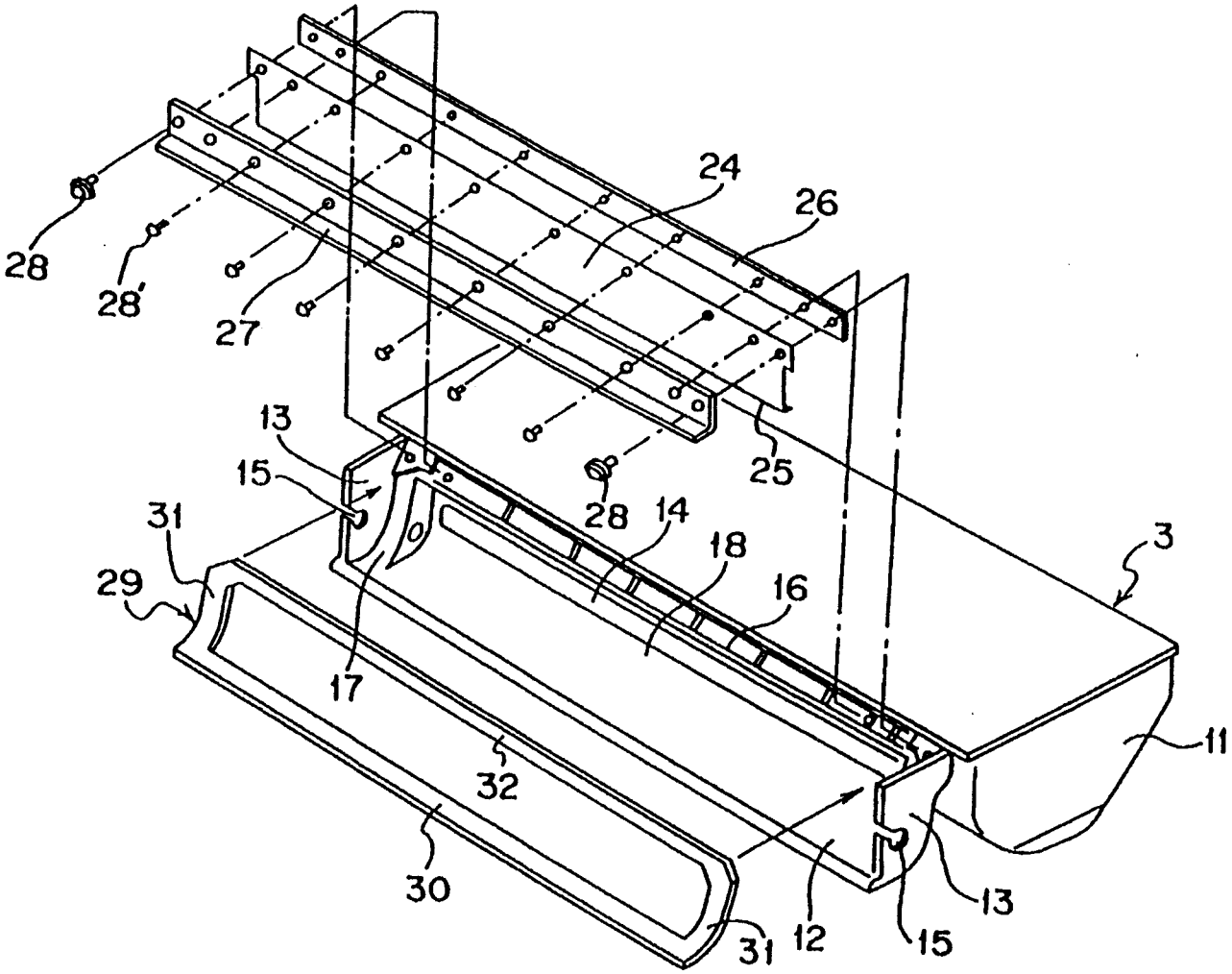
FIG. 6 is an exploded perspective view showing the housing, regulating panel, and elastic seal member of the developing device of FIG. 5.

As shown in FIG. 6, the regulating panel 24 is integrated with the metal panels 26 and 27 via a plurality of screws 28', but said regulating panel 24 and metal panels 26 and 27 also may be integrated by spot welding or the like. Furthermore, the metal panel 26 is unnecessary when the entire surface of the support portion of the regulating panel 24 is precisely welded, so as to integrate the metal panel 27 and the regulating panel 24 such that the position of the point of support of the spring force remains unchanged along the entirety of its length (said position being the edge of the regulating panel's free edge in the area of the weld).

In the previously described embodiment, the regulating panel 24, and metal panels 26 and 27 were of identical length, and were fixedly attached to the housing 11 via screws 28 at two points on bilateral ends of said members.

Although not shown in the drawings, the length of one panel among the regulating panel 24, and metal panels 26 and 27 may be longer than the other said members, so as to be fixedly attached to the housing 11 at two points on bilateral ends of the extended portion thereof.

In the previously described embodiment, a conductive metal thin layer of nickel is used as the thin layer sleeve 22 but it is to be understood that resin sheets of chromium, polyamide, polyester and the like, or laminate sheets comprising a resin sheet adhered on a metal thin layer may also be used. Furthermore, while the aforesaid embodiment was described in terms of a developing roller 20 comprising a roller 21 and a thin layer sleeve 22, it is to be noted that the present invention is adaptable to a developing roller without a thin layer sleeve 22.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device having a sealing construction for preventing a toner applicaton roller leakage therefrom, said developing device comprising:

accommodating means for accommodating a toner therein;

a rotatable member supported at said accommodating means for holding a toner on a peripheral surface thereof;

regulating means for regulating an amount of the toner supplied to said peripheral surface of said rotatable member, said regulating means including a scraper one end of which is supported at the accommodating means and the other end of which is pressed in contact with the peripheral surface of the rotatable member along an axial direction of the rotatable member; and a seal member for sealing a space between the accommodating means and the peripheral surface of the rotatable member, said seal member having a top seal portion, a bottom seal portion and a pair of side sealing portions, each of said side seal portions seamlessly integrated with both ends of said top seal portion and said bottom seal portion.

2. A developing device as claimed in claim 1 wherein said seal member is formed of polyurethane foam.

3. A developing device as claimed in claim 1 wherein said rotatable member includes a drive roller and a thin film sleeve having a larger circumference than a circumference of the drive roller, said thin film sleeve being mounted around a peripheral surface of the drive roller so as to be interposed between the drive roller and the seal member, whereby said thin film sleeve slides over the sealing member when the thin film sleeve rotates in synchronism with the rotation of the drive roller.

4. A developing device having a sealing construction for preventing a toner applicator roller leakage therefrom, said developing device comprising:

accommodating means for accommodating a toner therein;

a rotatable member supported at said accommodating means for holding a toner on a peripheral surface thereof;

regulating means for regulating an amount of the toner supplied to said peripheral surface of said rotatable member, said regulating means including a scraper one end of which is supported at the accommodating means and the other end of which is pressed in contact with the peripheral surface of the rotatable member along an axial direction of the rotatable member; and a square-frame shaped seal member arranged between the rotatable member and the accommodating means, said seal member having a bottom seal portion which seals a space interposed between the rotatable member and a bottom of the accommodating means, a side seal portion which seals a space interposed between both ends of the rotatable member and a side wall of the accommodating means opposed thereto, and a top seal portion which seals a space interposed between the scraper and a top wall of the accommodating means.

5. A developing device as claimed in claim 4 wherein said seal member is formed of polyurethane foam.

6. A developing device as claimed in claim 4 wherein said rotatable member includes a drive roller and a thin film sleeve having a larger circumference than a circumference of the drive roller, said thin film sleeve being mounted around a peripheral surface of the drive roller so as to be interposed between the drive roller and the seal member, whereby said thin film sleeve slides over the sealing member when the thin film sleeve rotates in synchronism with the rotation of the drive roller.

7. A developing device having a sealing construction for preventing toner leakage, said developing device comprising:

a rotating member opposed to a photoreceptor through an opening and holding toner on a peripheral surface thereof; and a seal member which seals a space formed between said opening and said rotating member, said seal member having a pair of side seal portions which respectively press against both sides of the peripheral surface of the rotating member, a top seal portion and a bottom seal portion each of which is seamlessly integrated with said side seal portions.

8. A developing device comprising:

accommodating means for accommodating a toner applicator roller therein;

a rotatable member supported at said accommodating means for holding a toner on a peripheral surface thereof;

regulating means for regulating an amount of the toner supplied to said peripheral surface of said rotatable member, said regulating means includes a scraper one end of which is supported at the accommodating means and the other end of which is pressed in contact with the peripheral surface of the rotatable member along an axial direction of the rotatable member; and a reinforcing member fixed to at least either of a front or a rear surface of said scraper along a portion in which the scraper is fixed to the accommodating means, both ends of at least the scraper or the reinforcing member being fixed to the accommodating means.

9. A developing device as claimed in claim 8 wherein said reinforcing member is integrally fixed to the regulating member by welding.

10. A developing device as claimed in claim 8 wherein said scraper is further fixed to a supporting member which acts as a point of support for the spring force of the scraper so as to be gripped by the reinforcing member and said supporting member.

11. A developing device as claimed in claim 8 wherein said rotatable member includes a drive roller and a thin film sleeve having a larger circumference than a circumference of the drive roller, said thin film sleeve being mounted around a peripheral surface of the drive roller so as to be interposed between the drive roller and a seal member arranged between the drive roller and the accommodating means, whereby said thin film sleeve slips from the sealing member when the thin film sleeve rotates in synchronism with the rotation of the drive roller.

* * * * *